United States Patent [19]

Maier et al.

[11] 4,260,113

[45] Apr. 7, 1981

[54] PROCESS AND APPARATUS FOR THE PRODUCTION OF CONSTITUENTS OF PARTICLE BOARD PANELS

[75] Inventors: Gerhard Maier; Udo Rosenke, both of Bielefeld; Manfred Humbert, Gutersloh; Walter Ritter, Hiddenhausen, all of Fed. Rep. of Germany

[73] Assignee: Maschinenfabrik B. Maier KG, Bielefeld, Fed. Rep. of Germany

[21] Appl. No.: 959,916

[22] Filed: Nov. 13, 1978

Related U.S. Application Data

[63] Continuation of Ser. No. 827,591, Aug. 25, 1977, abandoned.

[30] Foreign Application Priority Data

Aug. 31, 1976 [DE] Fed. Rep. of Germany ..... 2639123

[51] Int. Cl.[3] ..... B02C 18/18

[52] U.S. Cl. ..... 241/28; 241/248; 241/260

[58] Field of Search ..... 241/28, 244, 248, 101.4, 241/260; 144/326 R, 326 A-D, 230

[56] References Cited

U.S. PATENT DOCUMENTS

| | | | |
|---|---|---|---|
| 2,874,909 | 2/1959 | Pallmann | 241/28 |
| 3,957,094 | 5/1976 | Maier | 144/230 |
| 4,002,300 | 1/1977 | Mruck et al. | 241/244 X |

*Primary Examiner*—Mark Rosenbaum

*Attorney, Agent, or Firm*—Peter K. Kontler

[57] ABSTRACT

Chips of scrap wood having a length at least twice the desired length of shavings for the making of particle board panels, as considered in the direction of grain, are fed into a rotor having an annulus of blades which split the chips in the direction of grain and feed the comminuted chips into the range of stationary comb-like knives serving to subdivide the split chips into shavings of ultimate length.

6 Claims, 2 Drawing Figures

PROCESS AND APPARATUS FOR THE PRODUCTION OF CONSTITUENTS OF PARTICLE BOARD PANELS

CROSS-REFERENCE TO RELATED APPLICATION

This application is a continuation of our copending application Ser. No. 827,591 filed Aug. 25, 1977, now abandoned.

BACKGROUND OF THE INVENTION

The present invention relates to the production of flat shavings, especially from residues or scraps of wood. More particularly, the invention relates to a multi-stage process and apparatus for conversion of regularly or irregularly shaped pieces of wood into shavings of predetermined size and shape. Such shavings can be used for the manufacture of chipboard or particle board panels and may be obtained by further processing of residues or scrap from millwork, furniture or plywood manufacturing and similar operations.

It is already known to convert scrap wood (such as planks, slabs, rinds, splinters, fragments of logs, residue of plywood sheets or veneers) into chips by resorting to so-called drum- or disk-type comminuting machines. It is further known to reduce the size of such chips by resorting to knives (see German Auslegeschrift No. 2,332,121) or to rotary disks (as disclosed, for example, in German Offenlegungsschrift No. 1,942,531). The resulting shavings are ready to be utilized in the manufacture of particle board panels. The maximum length of shavings equals the maximum length of chips. It has been found that the quality and homogeneousness of shavings which are produced in accordance with the just outlined procedures (i.e., conversion of scrap wood into chips and conversion of chips into shavings) are not predicable to an extent which is necessary for the production of high-quality particle board panels. Thus, the homogeneousness of such shavings is invariably inferior to that of shavings which are produced by comminuting machines employing knife shafts. This is attributable to the fact that the orientation of grain is different from chip to chip. Consequently, comminution of chips results in an undesirably high percentage of short fragments because the chips do not tend to and infrequently assume such positions that their conversion into shavings takes place by subdivision in planes which are parallel to the grain. In other words, a high percentage of chips is severed in such a way that the cutting planes are normal to or make oblique angles with the longitudinal direction of the fibers. It was further found that chips of average length (normally between 30 and 40 millimeters) tend to break at right angles to the longitudinal direction of fibers, especially if the moisture content of wood is relatively low. This further contributes to the presence of undesirably high percentages of unsatisfactory fragments which are smaller than the optimum size of shavings in a particle board panel. Therefore, manufacturers of particle board panels or like products which consist of or contain a high percentage of wood shavings are reluctant to employ only shavings which are obtained from residues in spite of the obvious economical advantages of such procedure. In other words, and as a rule, particle board panels which are obtained on the market invariably contain a rather high percentage of shavings which are obtained from valuable wood, i.e., from wood which does not constitute remnants of logs, boards, beams and other wood products in millwork, manufacture of furniture, plywood and other woodworking operations.

OBJECTS AND SUMMARY OF THE INVENTION

An object of the invention is to provide a novel and improved process for the production of shavings which include a low percentage of shorts regardless of whether or not the shavings are obtained from residues or scrap wood.

Another object of the invention is to provide a novel and improved multi-stage process for the production of uniform or practically uniform shavings from scrap wood.

A further object of the invention is to provide a process for the production of shavings suitable for use in the manufacture of high-quality particle board panels which need not contain any or which contain a low percentage of shavings obtained from large pieces of wood by resorting to conventional comminuting machines, especially those employing knives.

An additional object of the invention is to provide a novel and improved machine for conversion of wood, especially scrap, into shavings which are ideally suited for the manufacture of particle board panels.

An ancillary object of the invention is to provide novel and improved stationary and mobile comminuting devices for use in the above outlined machine.

One feature of the invention resides in the provision of a process for converting pieces of wood, especially scrap wood, into shavings or fragments of predetermined length, particularly for use in the manufacture of particle board or chipboard panels. The process comprises the steps of comminuting pieces of wood into chips having a length (as considered in the direction of grain) which is at least twice the predetermined length, and thereupon subdividing the chips into fragments of predetermined length.

The subdividing step preferably comprises breaking up or splitting the chips into larger fragments or shavings whose length exceeds the predetermined length and (either immediately thereafter or simultaneously) breaking up the larger fragments into smaller fragments having the desired (predetermined) length.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
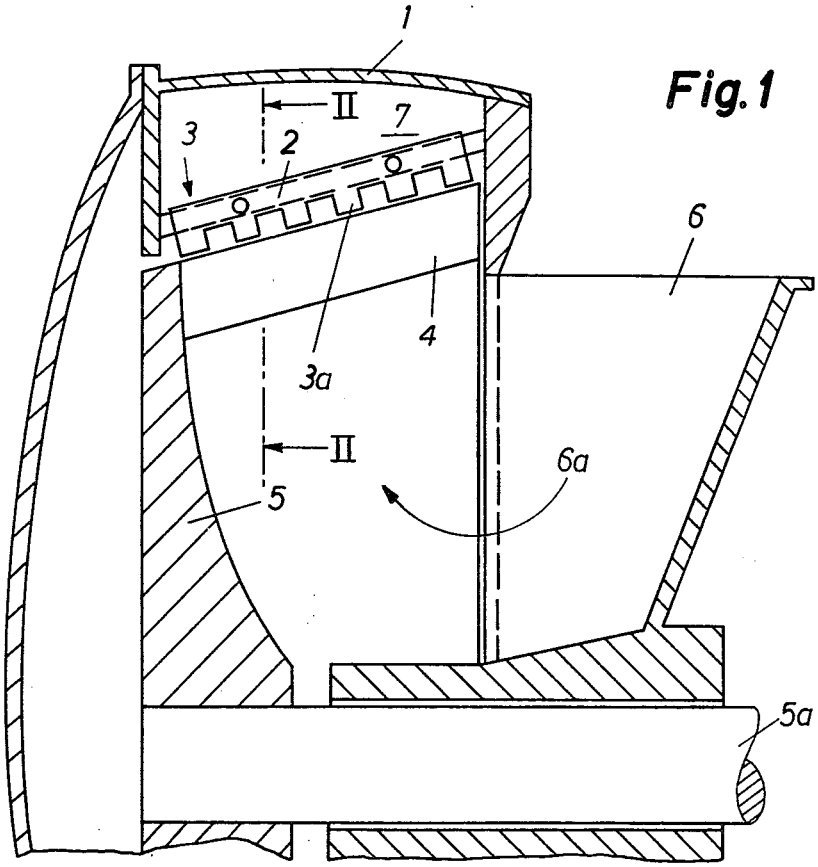
FIG. 1 is a fragmentary axial sectional view of a machine which embodies one form of the invention and serves for the production of uniform shavings from scrap wood.
Figure 2:
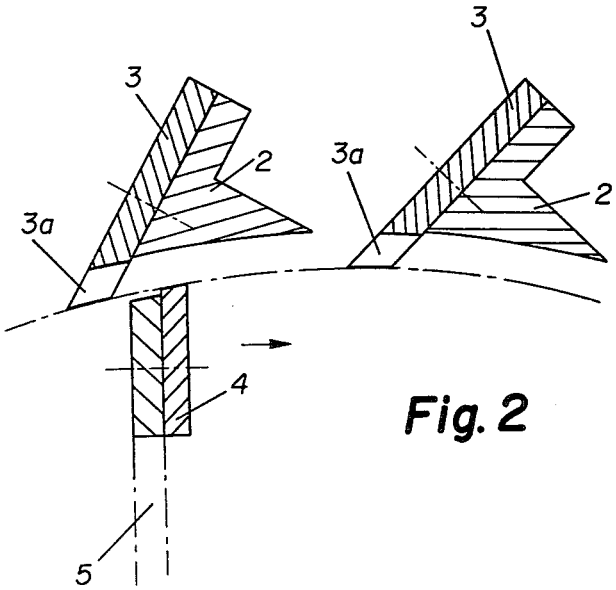
FIG. 2 is an enlarged fragmentary sectional view as seen in the direction of arrows from the line II—II of FIG. 1.

FIG. 1 shows a machine which comprises a rotor 5 driven by a shaft 5*a* which is journalled in a housing 1.

The housing 1 supports a stationary carrier or basket 2 which is a hollow frustum of a cone and carries a set of stationary comb-shaped knives 3 disposed in planes which include the axis of the shaft 5*a*. The knives 3 are outwardly adjacent to a conical array of comminuting blades 4 which are secured to and driven by the rotor 5. The housing 1 has an inlet 6 for admission of larger fragments or chips (not shown) which advance in the direction indicated by arrow 6*a* to be split by the orbiting blades 4 and stationary knives 3 in directions parallel to their grain and to be thereupon fragmentized into shavings during travel between the prongs or teeth 3*a* of the stationary knives 3 prior to entering the space 7 which surrounds the basket 2 and communicates with an outlet disposed at a level below the inlet. The smaller fragments or shavings which issue from the outlet are ready for use in the manufacture of particle board panels without addition of any other fragments.

The teeth 3*a* of the knives 3 extend radially inwardly, i.e., toward the adjacent blades 4 on the rotor 5. These teeth constitute but one form of means for reducing the length of shavings or fragments to a size which is best suited for the manufacture of particle board panels. The length reducing means can also include simple strip-shaped knives with additional scoring knives or knives having scoring lugs. Such knives are known per se. Reference may be had to U.S. Pat. Nos. 3,162,222 and 3,957,094. Furthermore, the basket 2 and the annulus of blades 4 may have a cylindrical rather than conical shape, or a combination of such shapes.

The process which can be carried out with the improved apparatus insures that the percentage of smaller fragments which are undesirable in a particle board panel is surprisingly low. Moreover, the quality and homogeneousness of smaller fragments or shavings which issue from the outlet of the housing 1 is highly satisfactory so that such fragments need not be mixed with fragments which are obtained from reusable wood.

The improved quality of fragments which issue from the housing 1 is attributed to the fact that the length of chips which are fed to the machine via inlet 6 is at least twice the desired length of shavings. As mentioned before, the length of shavings is normally in the range of 30–40 mm. Thus, the length of chips is at least 60 mm and normally does not exceed 150 mm. The admission of such relatively long chips renders it more likely that the chips will assume positions in which the blades 4 sever them in the direction of grain, i.e., that the chips are converted into relatively large fragments. Moreover, even relatively dry chips are less likely to reach the blades 4 in such positions that the blades would sever them at a right or oblique angle to the direction of grain. The final product contains a low percentage of shorts and the volume of shavings issuing from the housing 1 is large; these are two of the most desirable attributes of the constituents of a high-quality particle board panel.

The rotor 5 and its blades 4 not only break up the chips into relatively large fragments but also effect a desirable distribution of chips, as considered in the circumferential direction of the rotor. The larger fragments pass through the gaps between the blades 4 and the smaller fragments pass through the gaps between the knives 3.

The improved machine is capable of processing chips as well as relatively large pieces of scrap wood. In other words, it is even possible to admit into the inlet 6 fragments of wood which did not pass through a chipping machine. Such mode of operation can be resorted to if the length of fragments, as considered in the direction of grain, exceeds the width and/or thickness of the fragments. The improved machine has been put to actual use and the results of tests are highly satisfactory. The quality of shavings is superior to that of shavings which are obtained from scrap by resorting to conventional machines. Thus, the total surface area of the majority of shavings is large and the percentage of shorts and fines is low. The machine can also process fragments of plywood.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. A process for making shavings of predetermined length for use in the manufacture of particle board panels or the like from chips made of wood and having a length, as considered in the direction of grain, which is at least twice said predetermined length, comprising the steps of breaking up said chips into first shavings having a length exceeding said predetermined length; and simultaneously subdividing said first shavings into shorter shavings of said predetermined length.

2. A machine for the conversion of wood chips which issue from a chipping machine into shavings having a predetermined length which is at most one-half the length of chips, as considered in the direction of grain, comprising a stationary hollow carrier having inwardly extending knives separated by gaps for the passage of shavings; a rotor installed in the interior of said carrier, adapted to advance the chips outwardly against said knives and having comminuting elements cooperating with said knives to break up the chips into first shavings having a length exceeding said predetermined length by splitting at least a substantial part of the chips in the direction of grain; means for driving said rotor; means for admitting chips into the range of said comminuting elements; and means for reducing the length of the first shavings so that the first shavings yield shorter shavings having said predetermined length, said length reducing means being mounted on said carrier and forming part of said knives.

3. A machine as defined in claim 2, wherein said knives have radially inwardly extending prongs which constitute said length reducing means.

4. A machine as defined in claim 2, wherein said carrier is a frustoconical basket.

5. A machine as defined in claim 2, wherein said comminuting elements are blades located in planes including the axis of said rotor.

6. A machine as defined in claim 2, further comprising a housing for said carrier and said rotor, said admitting means including an inlet provided in said housing.

* * * * *